United States Patent [19]

Williams

[11] 4,184,640

[45] Jan. 22, 1980

[54] COAL GRINDING APPARATUS FOR DIRECT FIRED BURNERS

[76] Inventor: Robert M. Williams, 16 La Hacienda, Ladue, Mo. 63124

[21] Appl. No.: 903,236

[22] Filed: May 5, 1978

[51] Int. Cl.[2] ..... B02C 25/00

[52] U.S. Cl. ..... 241/34; 241/130; 241/68

[58] Field of Search ..... 241/34, 35, 130, 68

[56] References Cited

U.S. PATENT DOCUMENTS

| | | | |
|---|---|---|---|
| 2,172,317 | 9/1939 | Dickey | 241/35 |
| 2,352,312 | 6/1944 | Donaldson | 241/35 |
| 2,381,351 | 8/1945 | Hardinge | 241/35 X |
| 2,439,721 | 4/1948 | Dickey | 241/34 X |
| 3,337,142 | 8/1967 | Williams | 241/130 |
| 3,587,980 | 6/1971 | Henne | 241/34 X |
| 3,779,469 | 12/1973 | Putman | 241/34 X |
| 4,022,387 | 5/1977 | Williams | 241/130 |

FOREIGN PATENT DOCUMENTS

| | | | |
|---|---|---|---|
| 922912 | 4/1963 | United Kingdom | 241/34 |
| 384547 | 11/1973 | U.S.S.R. | 241/34 |
| 446309 | 4/1975 | U.S.S.R. | 241/34 |
| 555907 | 5/1977 | U.S.S.R. | 241/34 |

*Primary Examiner*—Robert L. Spicer, Jr.
*Attorney, Agent, or Firm*—Gravely, Lieder & Woodruff

[57] ABSTRACT

Coal grinding apparatus for direct coal fired burner systems in which coal usage is regulated by a speed controlled roller grinding mill operated in conjunction with a speed controlled spinner separator to control the size and volume of the coal output to match the requirements of the burner, and means to transport and control the transport of the properly sized coal to the burner by either a negative or positive acting fan.

6 Claims, 6 Drawing Figures

COAL GRINDING APPARATUS FOR DIRECT FIRED BURNERS

BACKGROUND OF THE INVENTION

The grinding of coal for use as a fuel in coal fired burners is usually carried out with either a bowl mill in which the grinding rollers are stationary but move radially while a bowl rotates, or a centrifugal roller mill having a fixed bull ring. The usual operation of the centrifugal roller mill is to set the rotational speed for its most efficient speed to produce maximum output, as well as to have a supply of coal in the grinding chamber to prevent metal to metal contact of the rolls on the bowl or bull ring. In some roller mills of the character seen in Williams prior U.S. Pat. No. 3,337,142 of Aug. 22, 1967 means is provided to control the position of the rollers so the speed of rotation of the rolls relative to the fixed bull ring can be increased to improve the mill output. In the prior Williams U.S. Pat. No. 4,022,387 of May 10, 1977, the rollers are set with an initial clearance relative to the stationary bull ring that is smaller than the product size. When the rolls are driven the roll pressure on the material at the bull ring is proportional to the square of the speed of rotation of the shaft carrying the rolls and only when the material quantity diminishes to less than the clearance space will the rolls reach the initial clearance setting, which is selected by resilient means thereby guarding the mill against destructive operation.

BRIEF DESCRIPTION OF THE INVENTION

This invention relates to apparatus for grinding coal to a size for efficient burner operation, and particularly to apparatus having the ability to adjust its output capacity over a wide range in excess of a two-to-one turn down ration.

The objects of the invention are to provide apparatus for grinding coal to be supplied as the fuel for firing boilers and the like, to provide fuel for a direct fired system using coal so the rate of supply can be regulated, and to provide cooperating units of apparatus such as a roller mill grinder and a rotary classifier in series but individually speed regulated so as the mill output is modulated the classifier is inversely modulated to maintain a uniform size for the coal particles.

The preferred apparatus for the direct supply of coal to a burner and to control the rate of supply of the ground coal comprises a roller grinder having free pivoting grinding rolls not subject to springs or resilient means for grinding the coal against the bull ring, drive means for the grinding rolls that modulates the rotation so the rolls grind the coal to desired size, a spinner separator in series with the roller grinder, means to modulate the speed of the spinner separator so the output of coal is held substantially to optimum size for the burner, and control means for regulating the supply of coal to the roller grinder and for controlling the roller grinder and spinner separator inversely as to speed.

BRIEF DESCRIPTION OF THE DRAWINGS

The preferred apparatus is embodied in equipment and its controls shown in the accompanying drawing, in which.

DETAILED DESCRIPTION OF THE APPARATUS

Figure 1:
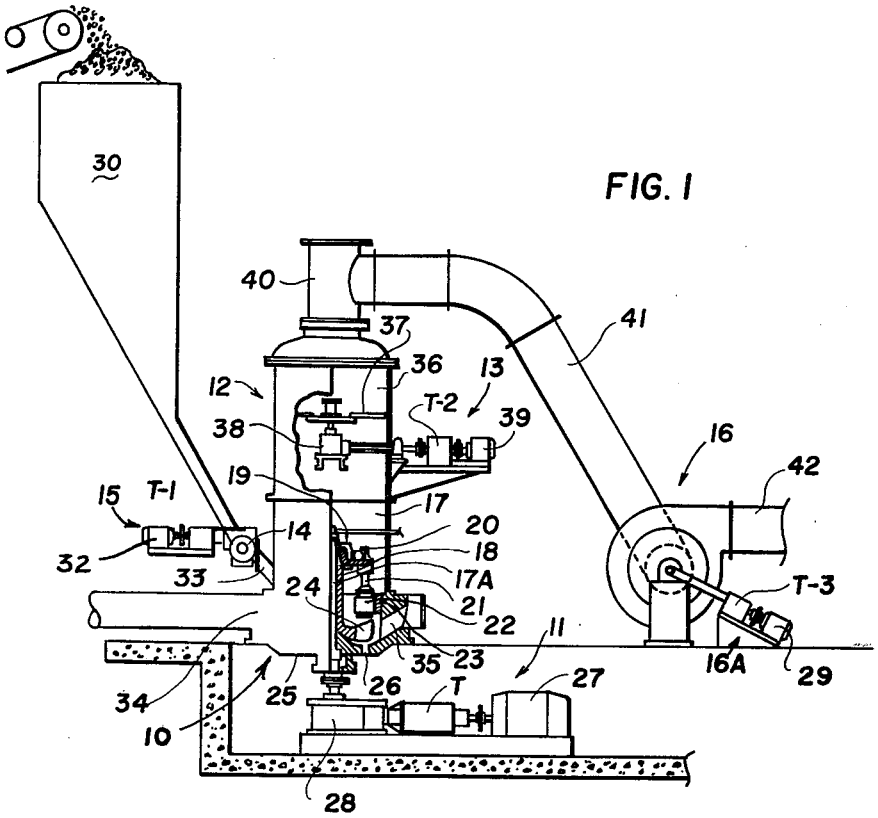
FIG. 1 is a schematic and partial sectional view of coal grinding apparatus having a negative air moving operation.

The apparatus presently preferred comprises an organization of a roller grinding mill 10 driven through a variable speed prime mover assembly 11, a spinner separator or mill output classifier 12 driven by its own variable speed prime mover assembly 13, a coal feeder with a rotary feed gate 14 driven by a prime mover assembly 15 of variable speed character, and a variable speed air moving fan 16 connected to the roller mill to move the ground product either by blowing it or sucking it through the mill and classifier. The fan 16 is provided with prime mover means 16A.

The apparatus of FIG. 1 is of the air suction type and includes a roller mill housing 17 enclosing a vertical drive shaft 17A having a drive sleeve 18 supported by the shaft 17A in position to carry a head 19 on which the trunions 20 for the suspended shafts 21 are carried. The grinding rollers 22 are mounted on the shafts 21 and move in a circular path inside a bull ring 23 carried in fixed position in the housing. The sleeve 18 extends below the path of the grinding rollers 22 to support and move plows 24 over the bottom wall 25 of the housing. The wall 25 is formed with an opening 26 for the escape of iron pyrites, slate, tramp metal, and other trash.

The prime mover assembly 11 includes the variable speed transmission T driven by motor means 27 and is connected to a suitable gear box 28 which is connected to the lower end of the shaft 17A. The transmission T connected to gear box 28 may be any suitable make that can be controlled to run the grinding rollers 22 at variable speeds. For example, the transmission T may be made by Synchrotorque, a division of Philadelphia Gear Corporation, and sold under the name Gear-Pak, a geared variable speed drive. This drive can be speed monitored to vary the centrifugal force applied to the rollers 22, and the rollers being free of springs or resilient means or other influences are directly responsive to such force.

The coal to be ground in the roller mill 10 comes from a hopper 30 which conducts it toward the rotary gate 14 driven by a variable speed transmission T-1 having a motor 32. The coal passed by the gate enters the feed chute 33 in the side of the housing to direct the coal into the grinding chamber above the path of the grinding rollers 22. The plows 24 below the rollers 22 keep lifting the coal up between the face of the bull ring 23 and the rollers 22. The housing 17 is provided with a surrounding hollow bustle ring 34 constituting an air chamber which opens through a plurality of ports 35 to the plow area, and air is admitted into the housing to lift the coal grindings upwardly into the classifier 12. The housing 36 of the classifier is a continuation of the mill housing 17 and encloses one or more spinner blades 37 driven through an angle gear box 38 from the external transmission T-2 driven by motor 39. The output of the classifier 12 is conducted through an outlet box 40 to a conduit 41 connected into the suction side of the coal-air moving fan 16. The fan output conduit 42 connects (not shown) to a burner. The suction effect of the fan 16 draws air into bustle 34 where it flows through the grinding chamber and classifier to box 40. Fan 16 is driven by a variable speed transmission T-3 connected to motor means 29.

Figure 2:
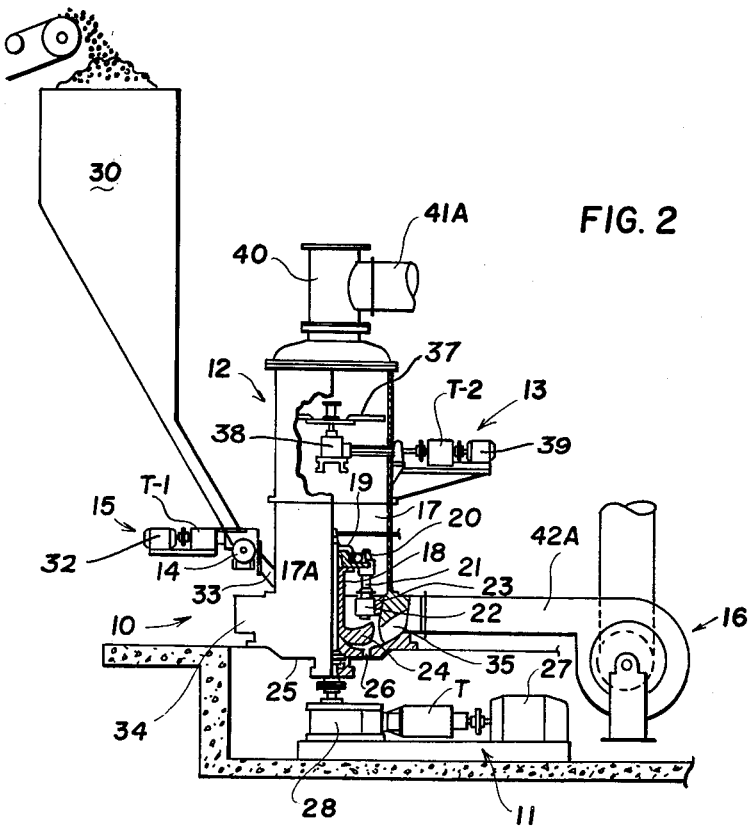
FIG. 2 is similar to the view of FIG. 1, but having a positive air moving operation.

The apparatus of FIG. 2 is comprised of substantially the same components disclosed in FIG. 1 and similar components will be easily identified by similar reference numerals. The essential difference is that the fan 16 now draws in ambient air or pre heated air from a suitable source and delivers it by conduit 42A directly into bustle 34 to flow upwardly through the grinding chamber where it effects a drying action as the ground coal is delivered by conduit 41A to the burner (not shown).

Figure 3:
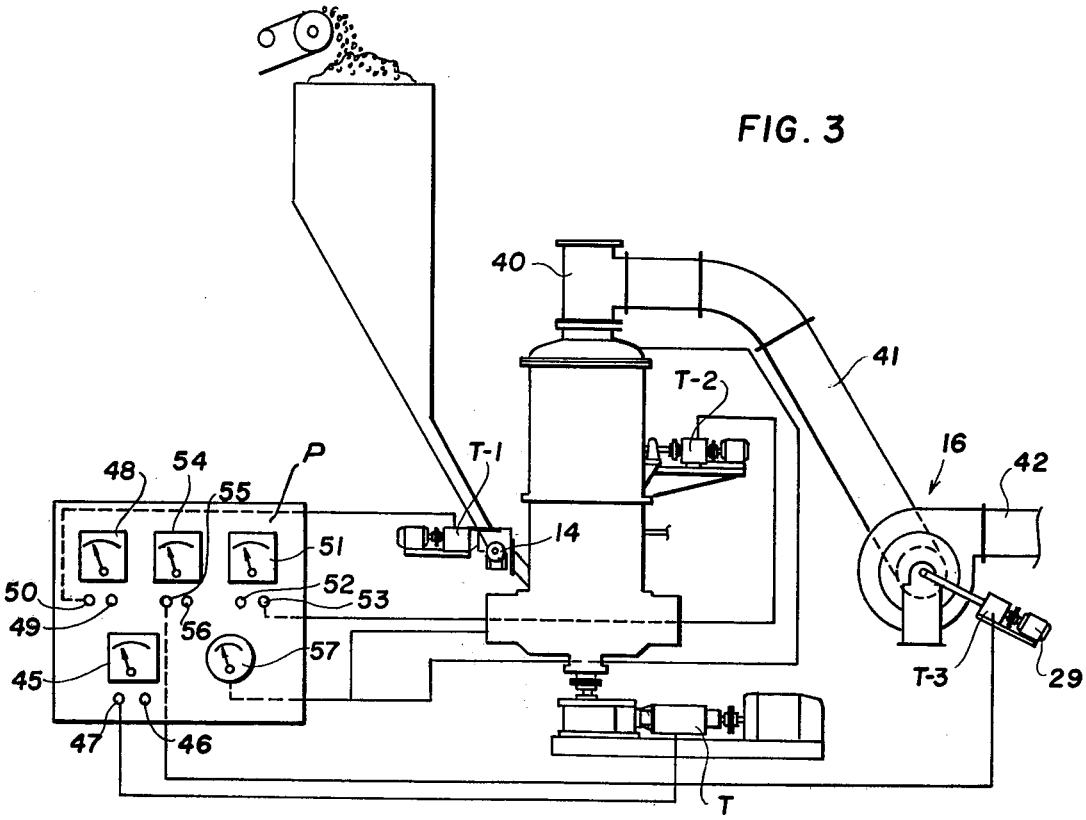
FIG. 3 is a schematic view of a control system for the apparatus for either FIG. 1 or FIG. 2.

The schematic control system seen in FIG. 3 is important in coordinating the several components to adjust the output of the mill to match the burner for direct air/fuel supply. The components to be controlled are represented in block form for simplicity of disclosure, and the control panel is similarly shown. The panel P is the face of a suitable box containing controls and the needed wiring. Thus, the dial 45 displays the speed (RPM) developed in the motor driven transmission T for the grinding rollers 22. The dial 45 is associated with a tell-tale light 46 to visually indicate when the mill is being driven, and with a manual knob 47 to adjust the speed of the transmission T over the speed range from zero to maximum. The speed of the coal feed gate 14 is displayed on dial 48 which has a tell-tale light 49 and a manual knob 50 to adjust the gate speed through its transmission T-1 over the full range to maximum feed rate. The classifier 12 has its transmission T-2 associated with a dial 51 and a tell-tale light 52 to indicate its operating condition, and a manual speed adjust knob 53 is provided to vary the speed. The speed of fan 16 is shown on dial and 54 may be adjusted by knob 55 and a tell-tale operation light 56 is provided.

Figure 4:
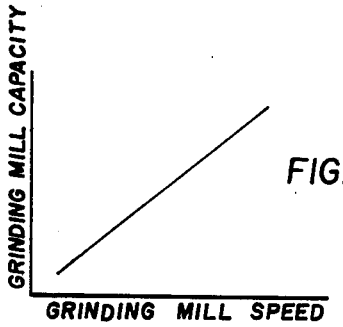
FIG. 4 is a chart illustrating the effect of speed control of the roller mill with respect to output capacity.
Figure 5:
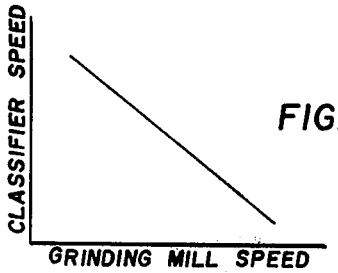
FIG. 5 is a chart illustrating the effect of speed control of the spinner separator with respect to output capacity which is a function of roller mill speed.
Figure 6:
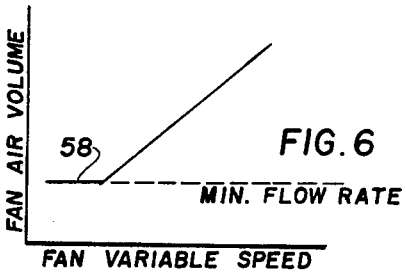
FIG. 6 is a chart illustrating the relation of air supply volume to fan variable speed which is required in the system to move the ground coal without it falling onto the bottom of the conduit.

The desired operating conditions for the apparatus of either FIG. 1 or 2 is illustrated in chart form in FIGS. 4, 5 and 6. These charts are illustrative of certain conditions, as will be pointed out. In FIG. 4 the capacity of the grinding mill is plotted against roller speed, such that as the roller speed increases the capacity of the grind increases. Thus, if the roller speed decreases the centrifugal force on the rollers decreases and the grinding rate is reduced at the same time. However, the product will get coarser. This is an undesirable condition because the coarse coal particles are harder to burn and cause wear problems in the conduit. Due to the controls the classifier 12 will speed up so that the coarse fractions of the coal will be returned internally to the mill for more exposure to the grinding rolls. FIG. 5 illustrates the relation of the speed of the classifier to that of the mill so as to maintain the coal at the desired fineness as the mill changes speed.

FIG. 6 illustrates the relationship of the air volume moved by fan 16 to the capacity of ground coal to be moved. Thus maintaining constant air to coal ratio. The ability to air move the ground coal reaches a minimum at a velocity of about 2000 feet per minute which just keeps the coal from settling along the bottom of the conduits. While fan speed control is illustrated in FIG. 6, it is possible as an alternate to operate the fan at a substantially uniform speed and vary the air admitted to the system by means of a damper (not shown).

What is shown in FIG. 3 is both a manual override control by push buttons 47, 50, 53 and 55, and an automatic control 57 which displays the differential pressure across the air bustle 34 and the output side of the classifier 12. This pressure differential may be predetermined, such as a pressure equivalent to eight inches of water. In automatic mode, the indicator 57 will display the differential pressure between the bustle 34 and outlet of the classifier 12. Should the pressure difference decrease that means that insufficient coal is being fed so the feeder transmission T-1 increases speed to restore the necessary coal feed to maintain the desired pressure differential. Also if the pressure increases, too much coal is being fed so a slow down is made at the feeder transmission T-1. Thus, changes in the pressure differential mean a change in output so the mill speed would change, and that would change the classifier speed inversely (see charts FIGS. 4 and 5). Further, the drive for the fan 16 would be adjusted to maintain a coal to air ratio suitable for the burner being supplied, as illustrated in FIG. 6, provided the air volume does not fall below the minimum indicated by the chart line 58.

The fan speed can be increased from a minimum at which just sufficient air is moved to keep the coal from dropping out and settling in the duct work. However, the coal production can fall below the desired coal to air ratio which means an air rich mixture is being supplied, but as the coal production increases the air flow will pull back into step so as to hold the desired coal to air ratio above the minimum fan air volume delivery.

The view of FIG. 2 shows air supply to fan 16 from what may be ambient air or a source of hot air for purposes of drying the coal. The hot air enters the bottom of the mill where it contacts the coal being agitated by plows 24 for efficient drying action. A similar provision is made in the apparatus of FIG. 1 by connecting a hot air supply conduit 42B to the air bustle 34. The apparatus shown in FIGS. 1 and 2 are unique in that when drying is important to prevent choking the mill so the mill efficiency is not impaired, a hot gaseous medium can be supplied at conduit 42B or from the exhaust conduit 42A from fan 16. The hot gaseous medium can be heated air or an inert heated medium.

What is claimed is:

1. In coal grinding apparatus for direct fired burners, the combination of: a roller mill having a grinding chamber with an inlet for the coal to be ground and a discharge for ground coal; grinding rolls rotatable within said grinding chamber for grinding coal by centrifugal force of said rolls against said grinding chamber; a source of gaseous medium connected into said grinding chamber for moving ground coal through said grinding chamber discharge; a second chamber connected to said grinding chamber adjacent said discharge for receiving the ground coal; rotary classifier means in said second chamber operable for classifying the ground coal for particle size and returning oversize coal to said grinding chamber; separate prime mover means connected to said grinding rolls and to said rotary classifier means; and control means connected to each of said prime mover means, said control means being effective to vary the speed of each of said separate prime mover means, whereby ground coal particle size discharged from said second chamber is maintained substantially uniform through adjusting the centrifugal force exerted by said rolls inversely with speed of said rotary classifier means.

2. The combination set forth in claim 1, wherein rotary coal feeder means is connected to said grinding chamber inlet, and said control means is operatively connected to said rotary coal feeder means and said prime mover means to vary the speed thereof whereby the quantity of coal in said grinding chamber is coordinated with the control of said prime mover means for maintaining substantially uniform feeding of coal to said grinding chamber.

3. The combination set forth in claim 1, wherein pressure responsive control means is operatively connected into the gaseous medium supply to said grinding chamber and said rotary classifier for maintaining a substantially uniform pressure differential in the flow between said grinding chamber and said rotary classifier.

4. The combination set forth in claim 1 wherein said prime mover means for said grinding means, classifier and air moving means are subject to said control means for maintaining a substantially uniform coordination of coal particle size to quantity whereby a predetermined ratio of fluid medium to coal feed is maintained.

5. The combination set forth in claim 1 wherein the gaseous medium is heated for drying of the coal during grinding thereof.

6. The combination set forth in claim 1 wherein said rotary grinding means includes plow means in position to agitate the coal in said grinding chamber, and said gaseous medium is heated, said plow means admitting the gaseous medium more thoroughly into the agitated coal.

* * * * *